US009024832B2

(12) United States Patent
Duron et al.

(10) Patent No.: US 9,024,832 B2
(45) Date of Patent: May 5, 2015

(54) MOUNTING ELECTRONIC COMPONENTS ON AN ANTENNA STRUCTURE

(75) Inventors: Mark W. Duron, East Patchogue, NY (US); Rehan K. Jaffri, New York, NY (US); Danielle N. Strat, Sound Beach, NY (US)

(73) Assignee: Symbol Technologies, Inc., Holtsville, NY (US)

( * ) Notice: Subject to any disclaimer, the term of this patent is extended or adjusted under 35 U.S.C. 154(b) by 1013 days.

(21) Appl. No.: 12/978,870

(22) Filed: Dec. 27, 2010

(65) Prior Publication Data

US 2012/0162037 A1 Jun. 28, 2012

(51) Int. Cl.

| | |
|---|---|
| ***H01Q 9/00*** | (2006.01) |
| ***H01Q 23/00*** | (2006.01) |
| ***H01Q 1/22*** | (2006.01) |
| ***H01Q 1/24*** | (2006.01) |
| ***H01Q 1/52*** | (2006.01) |
| ***H01Q 9/04*** | (2006.01) |

(52) U.S. Cl.

CPC ..... *H01Q 23/00* (2013.01); *H01Q 1/22* (2013.01); *H01Q 1/243* (2013.01); *H01Q 1/52* (2013.01); *H01Q 9/0421* (2013.01); *H01Q 9/0442* (2013.01)

(58) Field of Classification Search

USPC ..... 343/700 M, 702, 745, 700 MS

See application file for complete search history.

(56) References Cited

U.S. PATENT DOCUMENTS

| | | | | |
|---|---|---|---|---|
| 6,452,563 | B1 | 9/2002 | Porte | |
| 6,819,293 | B2 * | 11/2004 | De Graauw | 343/702 |
| 6,867,736 | B2 * | 3/2005 | Faraone et al. | 343/700 MS |
| 7,084,816 | B2 * | 8/2006 | Watanabe | 343/700 MS |
| 7,456,793 | B2 * | 11/2008 | Napoles et al. | 343/702 |
| 2007/0182651 | A1 * | 8/2007 | Grant et al. | 343/713 |
| 2007/0229366 | A1 | 10/2007 | Kim et al. | |
| 2007/0252703 | A1 * | 11/2007 | Kato et al. | 340/572.8 |
| 2009/0174604 | A1 | 7/2009 | Keskitalo et al. | |
| 2009/0256759 | A1 * | 10/2009 | Hill et al. | 343/702 |

FOREIGN PATENT DOCUMENTS

| | | | |
|---|---|---|---|
| KR | 1020071198371 | A | 10/2007 |
| KR | 1020100076500 | A | 7/2010 |
| WO | 2008978870 | A1 | 5/2008 |

OTHER PUBLICATIONS

PCT International Search Report and Written Opinion for Application No. PCT/US2011/1066694 dated Aug. 17, 2012.

* cited by examiner

*Primary Examiner* — Hoang V Nguyen
*Assistant Examiner* — Hai Tran

(57) ABSTRACT

A method and apparatus for mounting electronic components on an antenna structure includes at least one conductive antenna element 102, an insulating layer 106 disposed on the antenna element 102, at least one electronic component 108 disposed on the insulating layer 106, and at least one electrical trace 110 disposed on the insulating layer 106 and connecting to the at least one electronic component 108. The trace follows contours of the antenna structure, such that the trace and component are electrically isolated from the antenna element.

20 Claims, 3 Drawing Sheets

MOUNTING ELECTRONIC COMPONENTS ON AN ANTENNA STRUCTURE

FIELD OF THE DISCLOSURE

The present invention relates generally to antennas and more particularly to mounting electronic components on an antenna structure.

BACKGROUND

The size of wireless communication devices is being driven by the marketplace towards smaller and smaller sizes. Consumer and user demand has continued to push a dramatic reduction in the size and weight of communication devices. To accommodate this trend, there is a drive to combine components and functions within the device, wherever possible, in order to reduce the volume of the circuitry. However, internal antenna systems still need to properly operate over multiple frequency bands and with various existing operating modes. For example, network operators providing service on the fourth generation Long Term Evolution (4G LTE) are also providing service on 3G systems, and the device must accommodate both these systems and their operating frequencies. However, the 4G system uses lower operating frequencies than the 3G system, which translates to a larger antenna.

The need for enhanced operability of communication devices along with the drive to smaller device sizes results in conflicting technical requirements for the antenna. Moreover, in order to operate efficiently, internal antennas require a certain amount of mechanical space within the device, which becomes difficult with the shrinking geometry of these devices. In operation, a monopole antenna, such as a classic PIFA (Planar Inverted-F Antenna) will resonate when its length is electrically one-quarter of the wavelength of the frequency being radiated. A standing wave is established as the antenna gains and stores energy from the source driver. The Q of the antenna can be described as the energy stored per cycle of the driving radio frequency (RF) source. Another way of describing the Q of the antenna is to recognize that; on average, the wave front bounces back and forth Q times before it radiates. Yet another way to describe the Q of an antenna is to say that the voltage at the end of the antenna will rise by a factor Q times that of the driving voltage. The voltage along the antenna will follow a cosine distribution; being zero at the grounded end, being the drive level at the driving point, and Q times the drive level at the open end of the antenna. However, smaller devices require placing components closer together within the device, and therefore closer to the antenna elements, and will typically raise the Q of the antenna. Since the bandwidth of the antenna equals 1/Q of the antenna, the net result of antenna loading will be a reduction in bandwidth.

At present, it is desired to create dead air space around the antenna to guarantee its radiating efficiency. However, a problem arises in that any circuits that are near the antenna are subject to radiation from the antenna and will tend to detune the antenna. Additionally, any non-linear semiconducting junctions coupled to the RF field from the antenna can rectify the RF energy and cause unwanted harmonics to be radiated. This condition is exaggerated by closeness of the antenna to the adjacent circuits.

Shielding is the classic approach to de-couple adjacent circuits from the intentional radiators. However, a further problem arises when the shields invade the antenna space. The shields cause field and pattern changes as well as antenna detuning. Of course, the antennas can be readjusted and compensated for the invasion of the circuit shields, but generally at the expense of the bandwidth of the antenna system. At LTE frequencies, this bandwidth problem is severe even before the shield invades the space of the antennas. Therefore, the shields can then make a severe problem even worse.

Accordingly, there is a need to address the issue of electronic components located in close proximity to antenna elements, such that the electronic components do not degrade the antenna performance.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
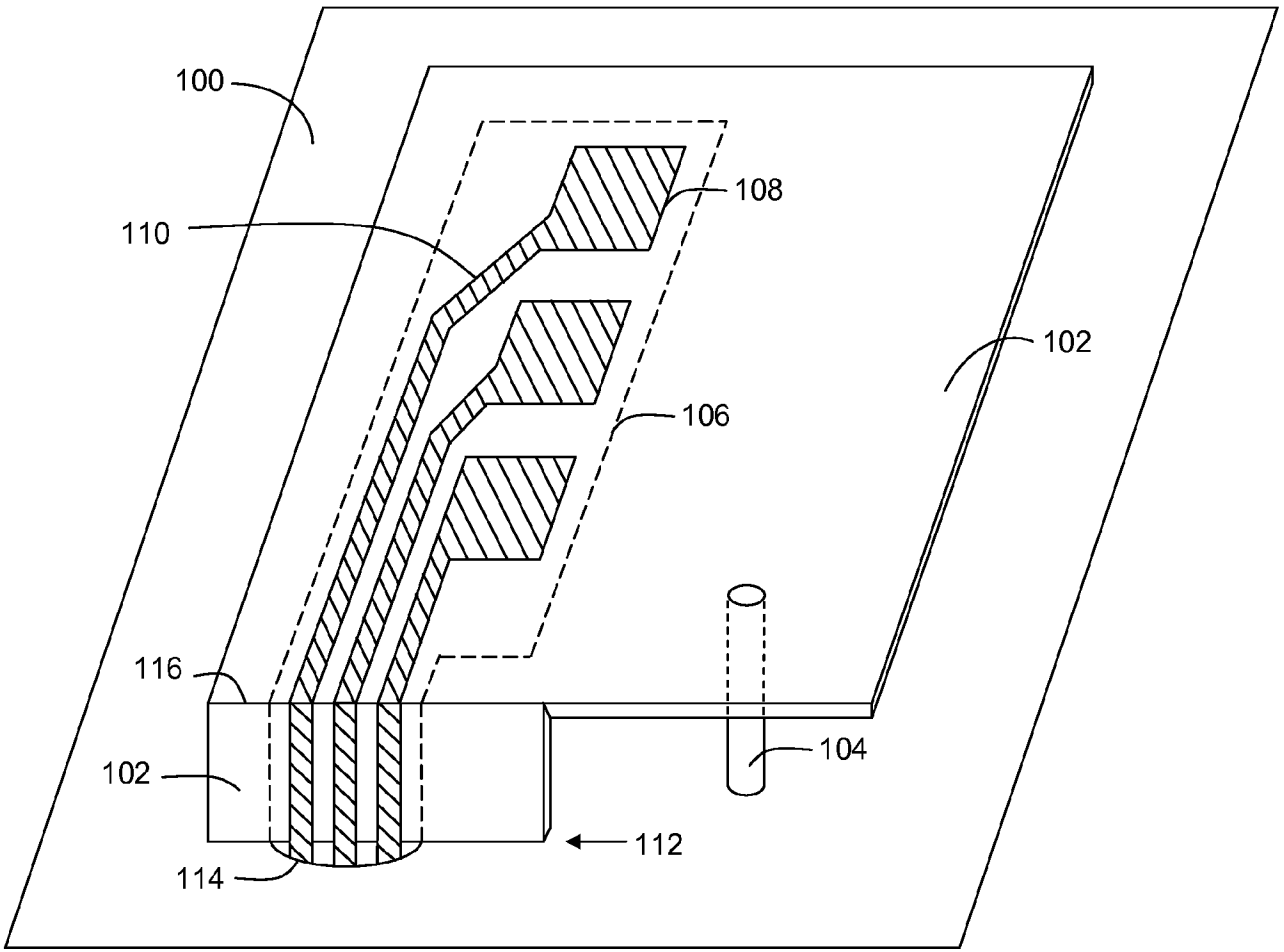
FIG. 1 is a perspective view of an antenna structure with components disposed thereon, in accordance with the present invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

The present invention provides a technique to mount electronic components proximal to antenna elements, such that the electronic components do not degrade the antenna performance. By recognizing the RF voltage distribution upon an antenna, the present invention uses this distribution to advantage by allowing other circuits to reside upon the antenna structure. As long as these circuits follow the contours of the antenna structure, they will be illuminated by the antenna and will be subject to the same RF voltage distribution as the antenna they reside upon. As the traces to these circuits cross the antenna grounding point, the RF voltages upon these circuits will also go to zero. This negates the need for circuit decoupling or shielding. In many cases, circuits that were forced to reside on the main printed circuit board area can now reside upon the antenna structure without the need for added isolation. The physical structure of the antenna inherently provides the required isolation to these parasitic circuits.

The present invention is best suited to components that have circuits which are traces only, such as dome switches and capacitive switch pickups. However, active circuits can be used as well, such as LEDs, small LCD displays, and microphones. Additionally, the component can be an antenna tuning circuit. All of these circuits have the advantage of isolation from and to the RF voltage distribution on the antenna. It should also be possible to mount tuners, matchers, and band switches directly on the antenna structure, in accordance with the present invention. The antenna is best used as the common ground for circuit control, where the circuits actually become part of the antenna structure. This assures that common mode fields will dominate.

Figure 2:
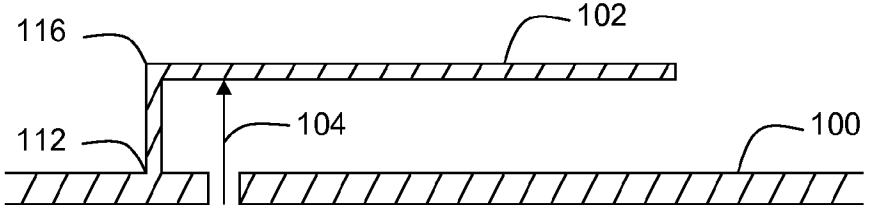
FIG. 2 is a cross-sectional side view of a prior art PIFA.
Figure 3:
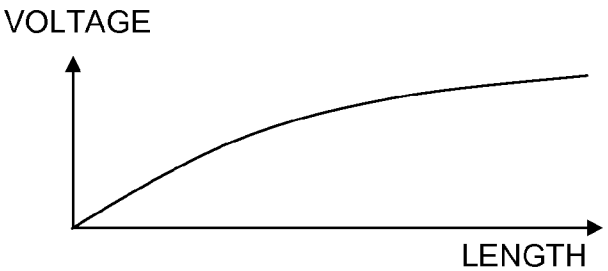
FIG. 3 is a graph of voltage distribution on the PIFA of FIG. 2.

FIG. 1 is a perspective view of a monopole type antenna structure with components disposed thereon, in accordance with the present invention. Such antenna structure can be used in various wireless communication devices. Although a planar inverted F-antenna (PIFA) structure is shown in this example, it should be recognized that the present invention is applicable to any other antenna type. As is known in the art, a PIFA structure includes a conductive plate 102 bent at a right angle along one edge 116, and where the conductive plate is connected to a ground plane 100 at a ground point 112, and is fed a signal at a feed point 104. The conductive plate 102 and location of the feed point 104 are tuned or configured for the operating frequencies of the communication device. FIG. 2 shows a side view of a representative example of a typical PIFA structure, and FIG. 3 shows the cosine RF voltage distribution expected for this structure along the length of the antenna element.

The present invention provides an insulating layer 106 (e.g. Kapton™ tape) disposed on the conductive plate 102 of the antenna structure, and electrical components 108 and their traces 110 disposed on the insulating layer 106 such that the components and traces are electrically isolated from the conductive plate. In particular, the traces to the components follow the contours of the antenna element of the underlying antenna structure (i.e. conductive plate 102) such that the traces substantially follow the RF path of currents in the conductive plate and the components and traces provide an electrical length substantially equivalent to the electrical length of the antenna element at the point where the components are disposed over the conductive plate. In this example, three capacitive touch pads are shown with individual traces. However, it should be recognized that combinations of different components and different numbers of components can be applied on the antenna structure.

The present invention also provides a via 114 through the ground plane 100, such that the conductive traces 110 can connect to a sensor circuit (e.g. 118 in FIG. 4) on the other side of the ground plane to detect when a use places their finger near one of the touch pads 108. For example, an electric field generated between a touch pad and the ground plane can provide a mutual capacitance, such that a user's finger placed in proximity to a touch pad can change the mutual capacitance between the touch pad and ground plane resulting in a disturbance to the electric field that is of a sufficient magnitude to be detected by a sensor circuit 118. Alternatively, a user's finger placed in proximity between two touch pads can change a self capacitance across the gap between the touch pads resulting in a disturbance to the electric field that is of a sufficient magnitude to be detected by a sensor circuit 118.

As the traces 110 to the touch pads 108 cross the antenna grounding point 112, the RF voltages upon these traces will also go to substantially zero, decoupling the traces from the antenna RF signal and provides superior decoupling to the analog circuits. This negates the need for specialized circuit decoupling or shielding. In effect, the components 108 and their traces 110 act as parasitic antenna elements, and can actually be configured to augment the radiation mechanism of the antenna structure. Alternatively, the traces 110 from the touch pads 108 do not need to go through the ground plane, but can follow an insulated path on the insulating layer 106 towards the ground point 112 of the antenna structure and then leading away from the ground point to a sensor circuit on an insulated top surface of the ground plane (not shown), such that the RF voltage on the traces adjacent to the ground point goes to substantially zero at the ground point decoupling the traces from the antenna element.

In the case of an antenna tuning circuit 120 residing upon the antenna structure, controls traces for the tuning circuit can also follow the antenna route to decouple them. Antenna measurements need not be done at the antenna, but can be done at a receiver, and then this information can be used to determine the correct tuning solution of the tuner residing upon the antenna. It should be recognized that any circuit or combinations of circuits can reside upon the antenna as long as they follow the antenna route to decouple the traces of those circuits.

In the case of capacitive touch pads residing upon the antenna structure, the present invention provides added benefits over the prior art, where a user placing their hand near or on the antenna results in disruptive antenna loading. Firstly, a user naturally will want to avoid placing their hands near a touch sensitive area, for fear of activating a feature. The user will only touch the switch/antenna when a switch function is required. This forces the user to keep their hand away from the switch/antenna area more often than if there were no touch switches present. This minimizes antenna hand loading effects. Secondly, the user will naturally press the switch with the finger tip, as opposed to the whole broadside of the finger. This again minimizes antenna loading. Thirdly, when a component is actuated, the system is aware that the antenna is being finger-loaded at the position of the particular component. This finger-loading can be modeled during the design of the communication device. Therefore, the system can tune, and compensate the antenna while the component is actuated using this predetermined model for finger-loading. In the prior art, the system never knows where a users hands are positioned, and therefore can not compensate for this.

Figure 4:
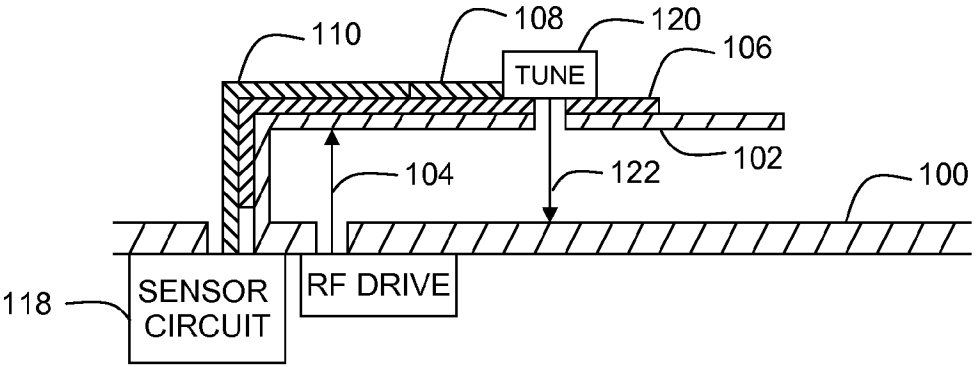
FIG. 4 is a cross-sectional side view of the antenna structure with components disposed thereon, in accordance with the present invention.

In accordance with this latter embodiment, and referring to FIG. 4, the present invention includes a sensor circuit 118 connected with the at least one trace 110 such that the sensor circuit can detect the actuation (e.g. a finger actuation) of the component 108. An antenna tuning circuit 120 disposed on the antenna structure is coupled to the sensor circuit 118 through at least one of the traces 110, and can tune the antenna using the predetermined model during the time when the sensor circuit detects actuation of the component 108. In operation, tuning will occur only when a user is currently actuating the sensor circuit, i.e. they have their finger over the component. The sensor circuit will then signal the tuning circuit 120 to apply tuning to the antenna through a ground probe 122, using the predetermined model dependent on which component is being actuated. Similarly, when the user removes their finger, which is detected by the sensor circuit, the tuning model is no longer applied. Although the sensor circuit 118 is shown below the ground plane 100 in this example, it could also be mounted above the ground plane on an insulating layer, as previously describes above.

Computer simulations have been conducted using capacitive touch pads and circuits disposed on a PIFA structure as describe herein. Plots of RF energy distributions show substantially no difference in RF energy on the touch pads or circuits from the surrounding antenna structure. Therefore, the components disposed on the antenna structure do not disturb the antenna function.

Figure 5:
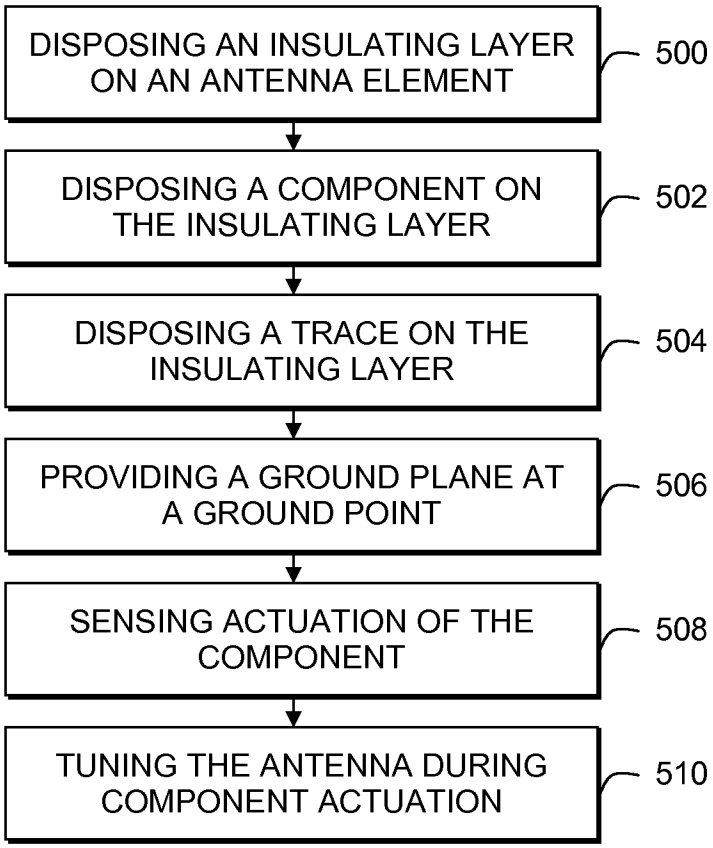
FIG. 5 is a flowchart of a method, in accordance with the present invention.

FIG. 5 illustrates a flowchart of a method for mounting electronic components on an antenna structure. The method includes a step of disposing 500 an insulating layer on an antenna element of the antenna structure, where the insulating layer approaches a ground point of the antenna structure. This step can also include disposing an insulated path leading away from the ground point of the antenna structure onto a top surface of a ground plane.

A next step includes disposing 502 at least one electronic component on the insulating layer such that the component is electrically isolated from the antenna element.

A next step includes disposing 504 at least one electrical trace on the insulating layer connecting to the at least one electronic component, such that the component is electrically isolated from the antenna element. The trace follows contours of the antenna structure, and the trace along with the component provide an electrical length substantially equivalent to the electrical length of the PIFA at the point where the component is disposed.

A next step includes providing 506 a ground plane connected to the antenna element at a ground point. This step can include providing a via through the ground plane at the ground point, wherein the at least one trace runs through the via crossing at the ground point to drive the voltage on the at least one trace to zero at the ground point decoupling the at least one trace from the antenna element. Alternatively, the at least one electrical trace follows an insulated path on the insulating layer towards the ground point of the antenna structure and then leading away from the ground point to a sensor circuit on an insulated top surface of the ground plane, to drive the voltage on the at least one trace to substantially zero at the ground point decoupling the at least one trace from the antenna element.

A next step includes sensing 508 an actuation of the at least one component.

A next step includes tuning 510 the antenna using a predetermined model during the time when the sensor circuit detects actuation of the at least one component.

Advantageously, the inventive technique described herein enables the mounting of circuits directly upon antennas, and using the inherent voltage distribution of the antenna to decouple the mounted circuits. As a result, the present invention saves space within the device while improving antenna loading effect of crowded components in a communication device.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. An apparatus for mounting electronic components on an antenna structure, the apparatus comprising:

at least one conductive antenna element including a conductive plate bent at a predetermined angle along an edge;

an insulating layer disposed on the antenna element;

at least one electronic circuit component disposed on the insulating layer directly over the antenna element; and at least one electrical trace disposed on the insulating layer and connecting to the at least one electronic circuit component, wherein the trace follows contours of the underlying antenna element and bends with the conductive plate at said predetermined angle along said edge.

2. The apparatus of claim 1, wherein the trace is disposed to follow an RF path of currents in the conductive antenna element.

3. The apparatus of claim 1, wherein the trace along with the component provide an electrical length substantially equivalent to the electrical length of the antenna element at the point where the component is disposed over the antenna element.

4. The apparatus of claim 1, further comprising:

a ground plane, wherein the antenna element is connected to the ground plane at a ground point; and a via through the ground plane at the ground point, wherein the at least one trace runs through the via crossing at the ground point to drive the voltage on the at least one trace to substantially zero at the ground point decoupling the at least one trace from the antenna element.

5. The apparatus of claim 1, further comprising:

a ground plane, wherein the antenna element is connected to the ground plane at a ground point; and wherein the at least one trace follows an insulated path on the insulating layer towards the ground point of the antenna structure and then leading away from the ground point to a sensor circuit on an insulated top surface of the ground plane, to drive the voltage on the at least one trace to substantially zero at the ground point decoupling the at least one trace from the antenna element.

6. The apparatus of claim 1, wherein the at least one component and its associated trace are configured to augment the radiation mechanism of the antenna structure.

7. The apparatus of claim 1, wherein the at least one component is a dome switch.

8. The apparatus of claim 1, wherein the at least one component is a microphone.

9. The apparatus of claim 1, wherein the at least one component is a display component.

10. The apparatus of claim 1, wherein the at least one component is a capacitive touch pad.

11. The apparatus of claim 1, wherein the at least one component is an antenna tuning circuit.

12. The apparatus of claim 1, further comprising:

a sensor circuit connected with the at least one trace, the sensor circuit operable to detect actuation of the at least one component; and an antenna tuning circuit coupled to the sensor circuit, the antenna tuning circuit tuning the antenna using a predetermined model when the sensor circuit detects actuation of the at least one component.

13. A communication device including an apparatus for mounting electronic components on an antenna structure, the apparatus of the communication device comprising:

at least one conductive antenna element including a conductive plate bent at a predetermined angle along an edge;

an insulating layer disposed on the antenna element;

at least one electronic circuit component disposed on the insulating layer directly over the antenna element; and at least one electrical trace disposed on the insulating layer and connecting to the at least one electronic circuit component, wherein the trace follows contours of the underlying antenna element and bends with the conductive plate at said predetermined angle along said edge.

14. A method for mounting electronic components on an antenna structure, the method comprising:

disposing an insulating layer on an antenna element of the antenna structure that includes a conductive plate bent at a predetermined angle along an edge;

disposing at least one electronic circuit component on the insulating layer directly over the antenna element; and disposing at least one electrical trace on the insulating layer connecting to the at least one electronic circuit component, wherein the trace follows contours of the underlying antenna structure and bends with the conductive plate at said predetermined angle along said edge.

15. The method of claim 14, wherein disposing the trace includes disposing the trace to follow an RF path of currents in the conductive antenna element.

16. The method of claim 14, wherein disposing the component and disposing the trace includes disposing the trace along with the component to provide an electrical length substantially equivalent to the electrical length of the antenna element at the point where the component is disposed over the antenna element.

17. The method of claim 14, further comprising providing a ground plane connected to the antenna element at a ground point, and a via through the ground plane at the ground point, wherein the at least one trace runs through the via crossing at the ground point to drive the voltage on the at least one trace to zero at the ground point decoupling the at least one trace from the antenna element.

18. The method of claim 14, further comprising providing a ground plane connected to the antenna element at a ground point, and wherein disposing an insulating layer includes disposing an insulated path leading away from the ground point of the antenna structure, and wherein disposing at least one electrical trace includes the at least one electrical trace following the insulated path on the insulating layer towards the ground point of the antenna structure and then leading away from the ground point to a sensor circuit on an insulated top surface of the ground plane, to drive the voltage on the at least one trace to substantially zero at the ground point decoupling the at least one trace from the antenna element.

19. The method of claim 14, further comprising:

sensing an actuation of the at least one component; and tuning the antenna using a predetermined model during the time when the sensor circuit detects actuation of the at least one component.

20. The method of claim 14, wherein, the antenna element is a folded conductive plate of a planar inverted F-antenna that serves as a common ground for the at least one component, wherein the conductive plate is connected to a ground plane of the antenna structure at a ground point, and wherein the electrical traces to the components cross the antenna grounding point.

* * * * *